United States Patent [19]

Wirz et al.

[11] Patent Number: 5,026,045

[45] Date of Patent: Jun. 25, 1991

[54] SHEET-GUIDING DRUM ASSEMBLY FOR SHEET-FED ROTARY PRINTING MACHINES

[75] Inventors: Arno Wirz, Bammental; Rudi Haupenthal, Epfenbach, both of Fed. Rep. of Germany

[73] Assignee: Heidelberger Druckmaschinen AG, Heidelberg, Fed. Rep. of Germany

[21] Appl. No.: 325,674

[22] Filed: Mar. 16, 1989

[30] Foreign Application Priority Data

Mar. 16, 1988 [DE] Fed. Rep. of Germany ..... 3808749

[51] Int. Cl.[5] ..... B65H 5/12

[52] U.S. Cl. ..... 271/277; 271/82; 226/175; 226/191

[58] Field of Search ..... 271/82, 277; 226/175, 226/191

[56] References Cited

U.S. PATENT DOCUMENTS

| | | | |
|---|---|---|---|
| 1,082,946 | 12/1913 | Grignard . | |
| 1,085,908 | 2/1914 | Hoe | 226/175 |
| 1,358,843 | 11/1920 | Grass . | |
| 4,092,917 | 6/1978 | Groome | 226/191 X |
| 4,334,473 | 6/1982 | Becker | 271/277 X |

FOREIGN PATENT DOCUMENTS

| | | |
|---|---|---|
| 1536999 | 2/1970 | Fed. Rep. of Germany . |
| 2040712 | 8/1973 | Fed. Rep. of Germany . |
| 2530365 | 1/1977 | Fed. Rep. of Germany . |
| 7522036 | 5/1977 | Fed. Rep. of Germany . |
| 2946252 | 2/1982 | Fed. Rep. of Germany . |
| 3328451 | 2/1985 | Fed. Rep. of Germany . |
| 3447596 | 7/1986 | Fed. Rep. of Germany . |
| 3422443 | 8/1986 | Fed. Rep. of Germany . |

*Primary Examiner*—Richard A. Schacher

*Attorney, Agent, or Firm*—Herbert L. Lerner; Laurence A. Greenberg

[57] ABSTRACT

Sheet-guiding drum assembly for sheet-fed rotary printing machines includes a drum formed with a casing surface and provided with a casing foil disposed so as to have a given outer diameter, a member arranged beneath the casing foil and on the casing surface of the drum, and a device for varying the height of the member on the casing surface for varying as well the outer diameter of the casing foil.

19 Claims, 10 Drawing Sheets

SHEET-GUIDING DRUM ASSEMBLY FOR SHEET-FED ROTARY PRINTING MACHINES

The invention relates to a sheet-guiding drum assembly for sheet-fed rotary printing machines and more particularly, to such an assembly including a drum formed with a casing surface and provided with a casing foil.

A sheet-guiding drum for sheet-fed rotary printing machines has become known heretofore from U.S. Pat. No. 4,227,459. In this heretoforeknown drum, a tensioned blanket is provided on the drum casing which is supposed to prevent smearing of a printed sheet on the surface of the sheet-guiding drum. The surface of this tensioned blanket contains microscopically small glass beads or spheres which prevent the deposit of ink on the surface.

It has been found that, during the printing of types of paper of varying thickness, a further problem occurs which can lead to a smudgy printed image. All of the conventional sheet-guiding drums have a fixed outer diameter. This outer diameter is of such dimension that even for maximum paper thickness, no tensile or stretching forces act upon the sheet because of the higher sheet transport velocity of the sheet on the sheet-guiding drum which is caused by the great paper thickness. It is therefore necessary that the outer diameter of the sheet-guiding drum, inclusive of the foil or tensioned blanket disposed thereon, be smaller than the working diameter of the impression cylinder of the press. If thinner papers are then processed, the smaller diameter of the sheet-guiding drum results in a loop formation of the sheet and to the formation of a follower or trailer portion of the sheet, respectively, on the impression and blanket cylinder, respectively. Such a follower or trailer portion, particularly for first form and perfector printing as well as for first form printing with a relatively thick application of ink, causes smeary and, consequently, considerable impairment of the printing quality. Furthermore, such a follower or trailer, during line printing, causes an abrupt stripping or tear-off movement which likewise promotes smearing.

It is accordingly an object of the invention to provide a sheet-guiding drum assembly for sheet-fed rotary printing machine which avoids and reduces, respectively, a follower or trailer portion of a sheet on a blanket and impression cylinder, respectively, through the use of relatively simple and economical means.

With the foregoing and other objects in view, there is provided, in accordance with the invention, a sheet-guiding drum assembly for sheet-fed rotary printing machines, the assembly including a drum formed with a casing surface and provided with a casing foil disposed so as to have a given outer diameter, comprising a member arranged beneath the casing foil and on the casing surface of the drum, and means for varying the height of the member on the casing surface for varying as well the outer diameter of the casing foil.

A considerable advantage of the invention is the relatively rapid matching or adjustment of the sheet-guiding drum to the thickness of the material which is being printed on. This matching is achieved, furthermore, in the case of a relatively high, concentric running accuracy. A further advantage is the relatively simple installation in all types of printing machines of elements for accomplishing the foregoing. Application of the invention is found both in printing machines with printing units in series construction as well as multicylinder machines, and also in machine with sheet-guiding drums which have a diameter which is a multiple of the diameter of the plate cylinder.

A device with which the diameter of an impression cylinder may be varied has become known heretofore from German Published Non-Prosecuted Application (DE-Al) 29 46 252. This known device serves for compensating or equalizing the variation in printing lengths of a paper sheet which travels through one or more printing units of a printing machine. This known device, however, is not suited for matching or adjusting the sheet-guiding drum to various diameters because it is possible to effect a change in diameter therein only within a very limited range: moreover, this change in diameter, because of the relatively high adjustment forces, requires an hydraulic pressure system which is very costly and causes sealing problems.

The elements which are variable in height may be formed, for example, of spring tongues made of spring steel plates or sheets or of parts of elastic synthetic material, for example, in the form of spring-acting cams or of any other type of spring acting elements of suitable structure or material properties. Concentric variation in the diameter is improved further in accordance with the invention by inclining the direction of operation of the spring-acting elements to the adjustable tensioning device.

Instead of spring-acting elements, which are tensioned by a tensioning device, adjustable elements may also be provided beneath the casing foil by means of a suitable drive, in which case then the casing foil per se is resiliently tensioned. A suitable servo-drive which produces a change in the height of the element, for example, hydraulically, electrically or pneumatically, can be installed as the drive.

If the casing foil is tensioned at the front and rear tensioning locations by a respective adjustable tensioning device, the operating direction can be split or divided in the middle between the tensioning locations so that one-half of the support elements refer to one of the tensioning locations, and the other half of the support elements to the other tensioning location.

In accordance with a particular construction of the invention, the tensioning of the casing foil is introducible via several tensioning elements arranged over the length of the axis of the drum. The additional possibility is thereby afforded of constructing the support foil concave or convex in axially direction of the drum by varyingly tensioning the individual tensioning elements, for example, so as to avoid a narrow printing effect.

The tensioning device for tensioning the casing foil can be suitably constructed in accordance with the invention so that both a movement in peripheral direction as well as a radial movement is performed. If the casing foil is tensioned only in peripheral direction, this in fact effects a reduction in diameter over the resiliently braced region of the casing foil, however, this diameter would not be reduced at the tensioning location. It is necessary, therefore, to perform a movement in radially inward direction i.e. towards the middle of the drum, in addition to the tensioning movement in the peripheral direction, in order to effect a reduction in diameter over the entire periphery of the sheet-guiding drum. The construction of the invention which would perform both of these superimposed movements is such that the adjusting device is displaced along an exactly defined guide path or swivelled about a pivot pin which extends along the drum axis and is arranged within the sheet-guiding drum.

A further construction according to the invention calls for the tensioning device to be adjusted via a servo-drive which may be either an electric motor or a pneumatic cylinder which is controllable via a console or control board or desk. Such a remote control is advantageous mainly for printing machines which are of series construction, because such machines have a multiplicity of sheet-guiding drums. Making the machine ready and adjusting the machine, respectively, to a new paper thickness can thereby be effected automatically.

In accordance with a further feature of the invention, the member has a multiplicity of individual support elements for yieldingly supporting the casing foil over the entire surface thereof on the casing surface of the drum.

In accordance with an added feature of the invention, the means comprise an adjustment device fastened to at least one tensioning location of the sheet-guiding drum for producing a variation in the outer diameter of the casing foil.

In accordance with an additional feature of the invention, the adjustment device has means for simultaneously moving the casing foil both in peripheral direction of the drum as well as in radial direction thereof, the movement of the casing foil in radial direction corresponding to a reduction in the outer diameter of the casing foil resulting from the movement of the casing foil in the peripheral direction.

In accordance with again another feature of the invention, the adjustment device comprises a tensioning rail extending along the axis of the drum and mounted in guide rails at end faces of the drum, the casing foil being fastened to the tensioning rail, the tensioning rail being moveable in a direction which is inclined to a tangent to the tensioning location of the casing foil on the sheet-guiding drum.

In accordance with again a further feature of the invention, the adjustment device comprises a tensioning rail for tensioning the casing foil, the tensioning rail being arranged within the drum so as to be swivellable about an axis extending substantially parallel to the axis of the drum.

In accordance with again an added feature of the invention, means for yieldingly fastening the casing foil to at least one tensioning location of the sheet-guiding drum are included, the means for varying the height of the member comprising a servo-device.

In accordance with again an additional feature of the invention, the member is formed of a support plate having spring tongues distributed over the surface thereof.

In accordance with yet another feature of the invention, the member is formed of a support material having resiliently acting support elements.

In accordance with yet a further feature of the invention, the member is formed of a support material wherein resiliently acting support elements of rubber or synthetic material are disposed.

In accordance with yet an added feature of the invention, the member is formed of at least one length of elastic hose fastened to a support foil.

In accordance with yet an additional feature of the invention, the member is formed of a plurality of strips arranged together with spring elements in a surface structure of the drum so that the strips are spring-biased in radial direction of the drum.

In accordance with still another feature of the invention, the member is formed of a plurality of cams arranged together with spring elements in a surface structure of the drum so that the cams are spring-biased in radial direction of the drum.

In accordance with still a further feature of the invention, the yieldingly supporting support elements are resiliently biased in a direction out of a normal to the peripheral direction of the drum.

In accordance with still a further feature of the invention, the member and the casing foil are formed with openings for conducting blowing air therethrough to the surface of a printed sheet disposed on the casing foil.

In accordance with still an added feature of the invention, the adjustment device comprises at least three like mechanisms distributed over the length of the drum.

In accordance with still an additional feature of the invention, the adjustment device is assembled with at least one servo-drive connected to a remote-control unit.

In accordance with another feature of the invention, means are included for promoting a sliding effect disposed between the support elements and at least one of the casing foil and the casing surface of the sheet-guiding drum for reducing friction.

In accordance with a concomitant feature of the invention, the means for promoting a sliding effect are selected from the group consisting of sliding media and sliding foils.

Other features which are considered as characteristic for the invention are set forth in the appended claims.

Although the invention is illustrated and described herein as embodied in sheet-guiding drum assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 2:
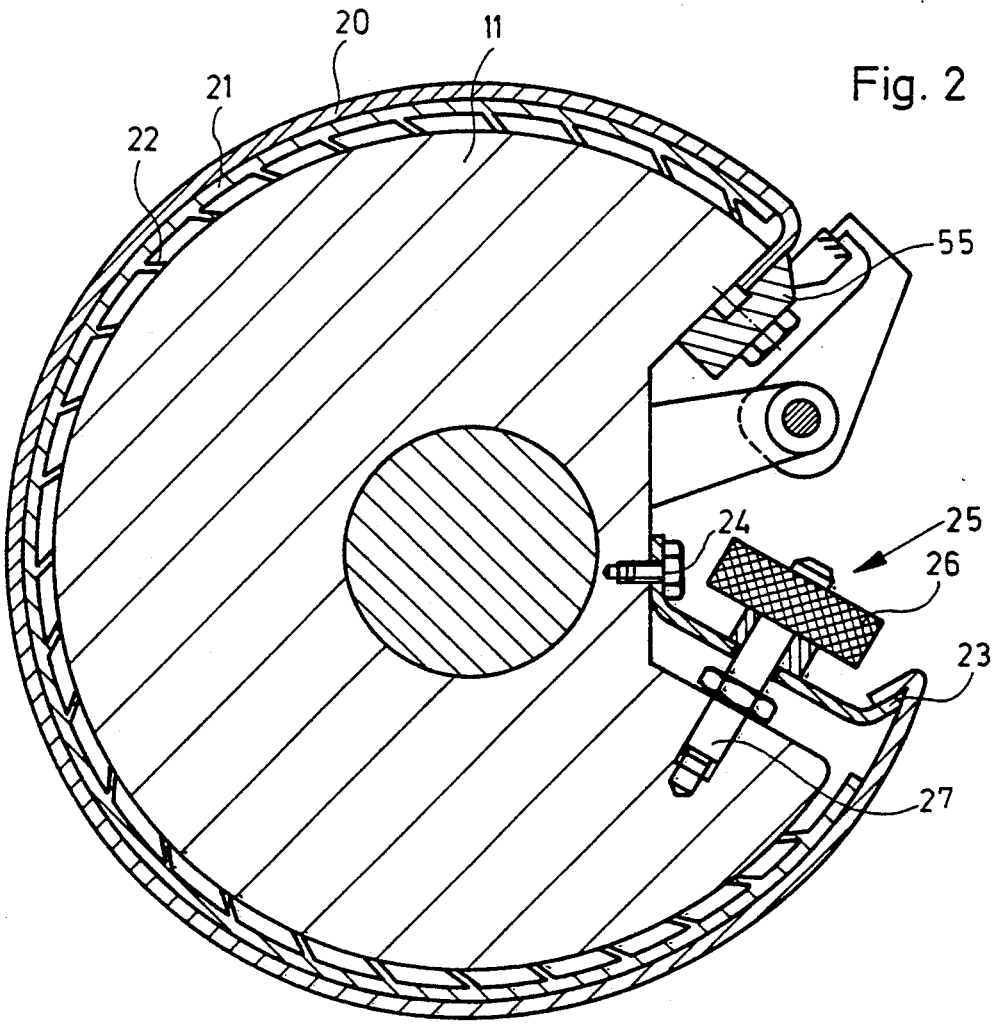
FIG. 2 is a cross-sectional view of a sheet-guiding drum having a support or carrier plate arranged thereon in accordance with the invention.
Figure 3A:
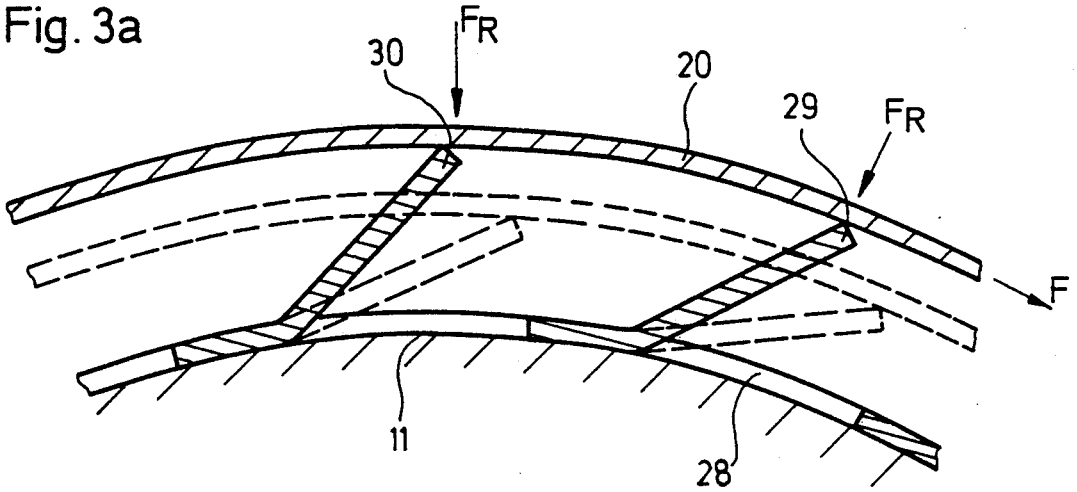
Figure 3B:
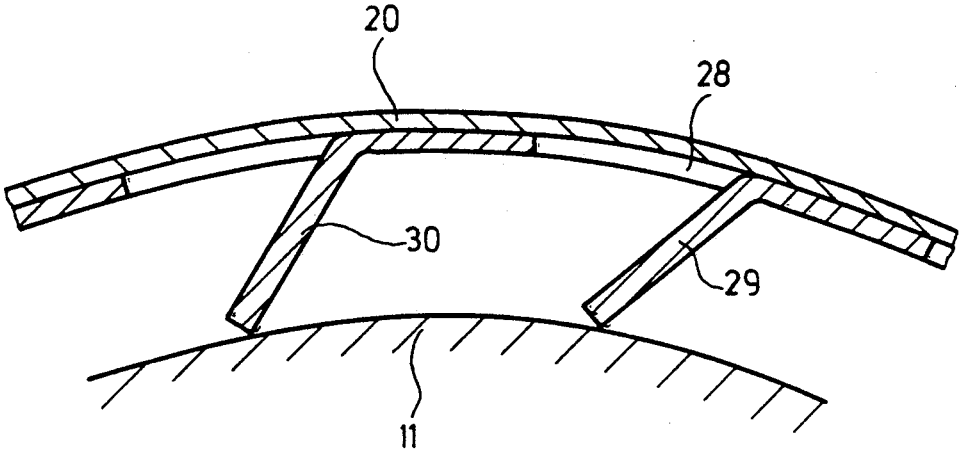
Figure 3C:
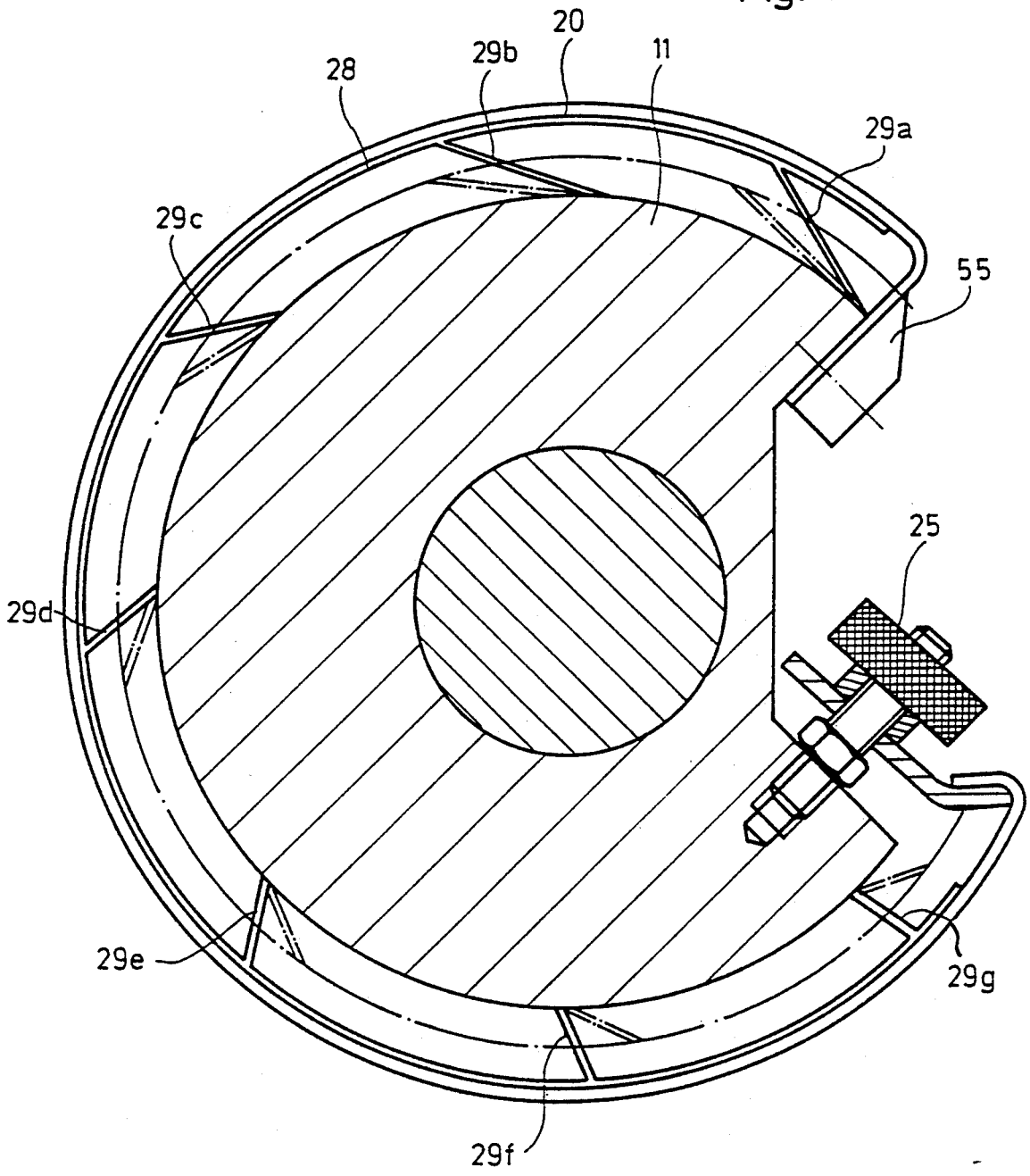
Figure 3D:
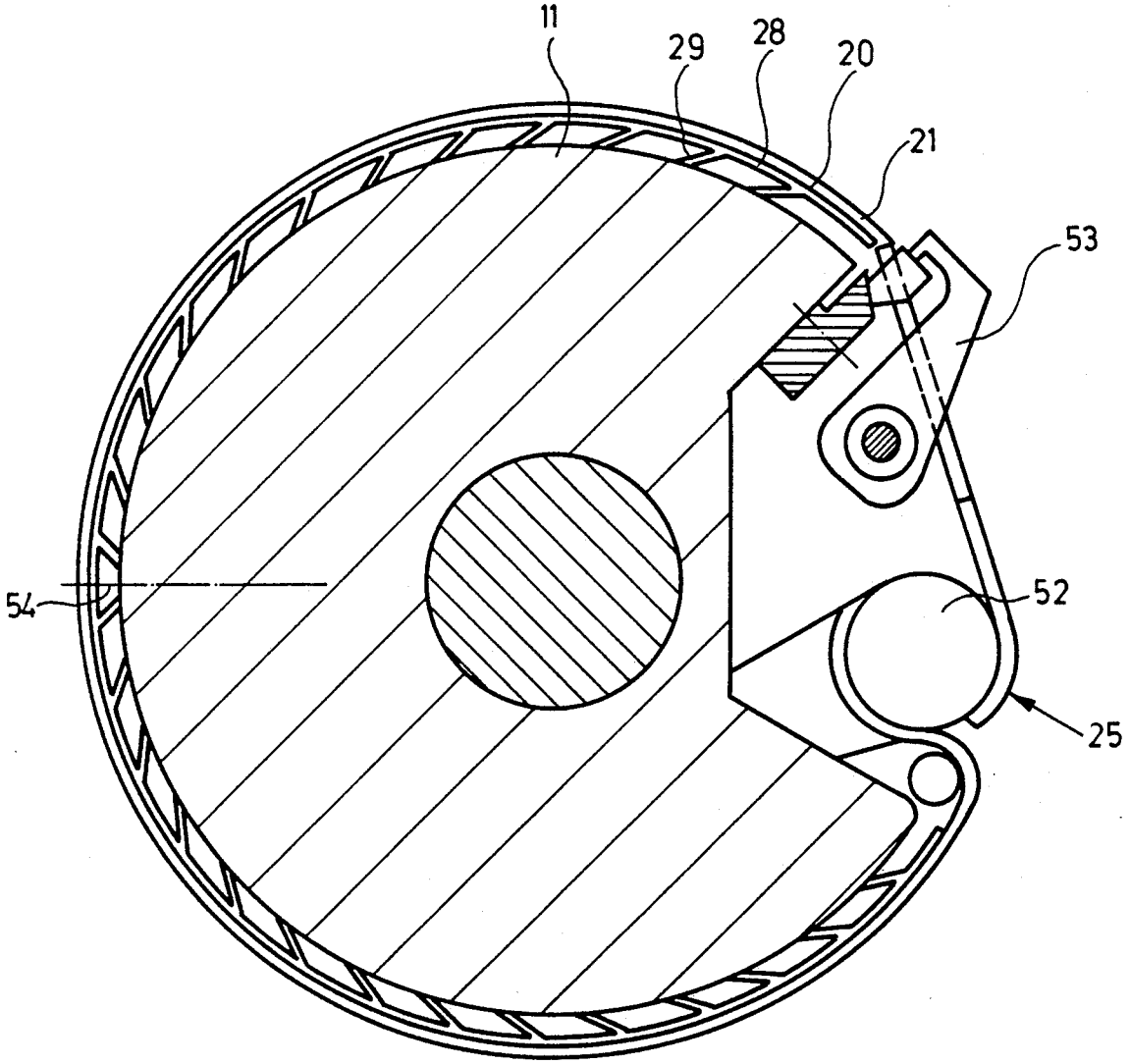

FIGS. 3*a* and 3*b* are enlarged fragmentary views of FIG. 2 showing different embodiments of the carrier plate with carrier elements in accordance with the invention;

FIG. 3*c* is a cross-sectional view of another sheet-guiding drum having a further embodiment of the carrier plate with support or carrier elements disposed thereon, and showing a specific arrangement of the carrier elements;

FIG. 3*d* is a cross-sectional view of a third sheet-guiding drum having a carrier plate with carrier elements disposed thereon, and showing a different arrangement of the carrier elements from that of FIG. 3*b;*

Figure 4A:
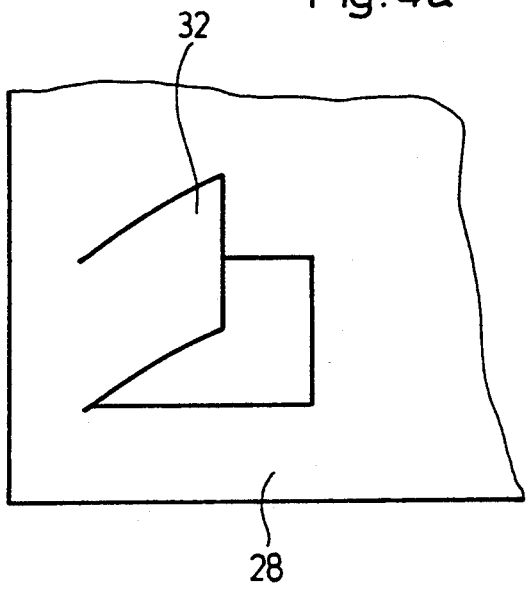
Figure 4B:
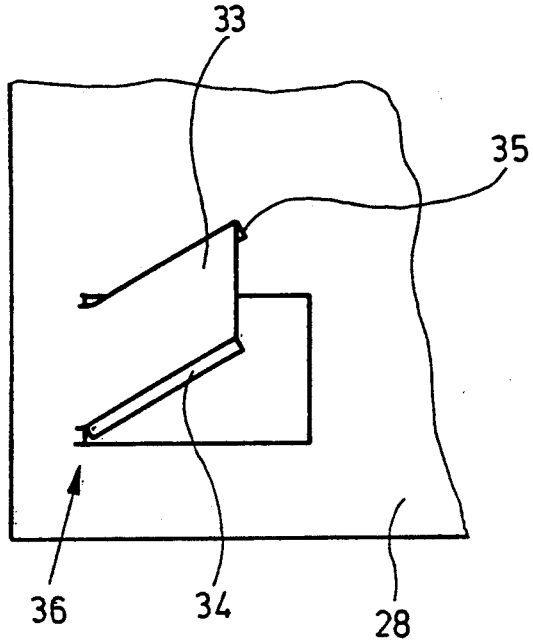
Figure 5A:
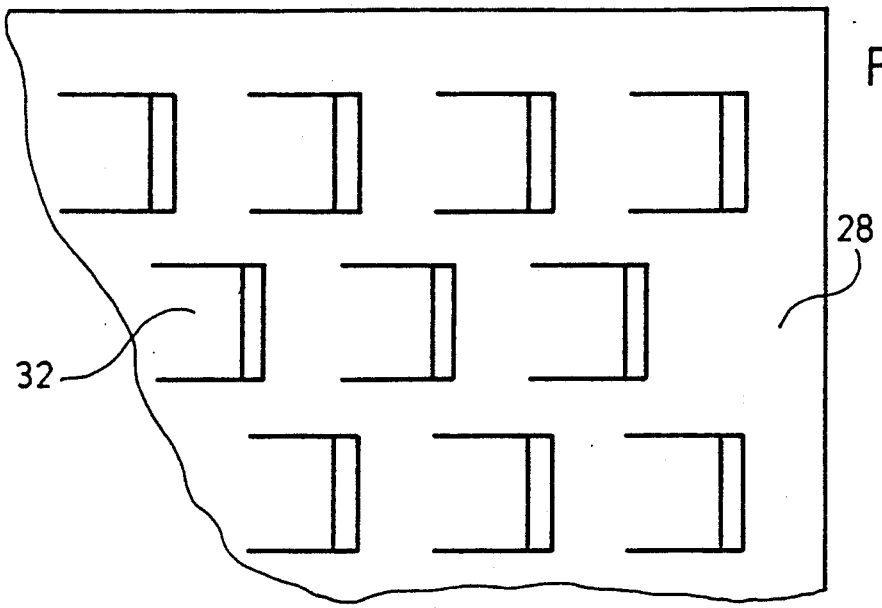
Figure 5B:
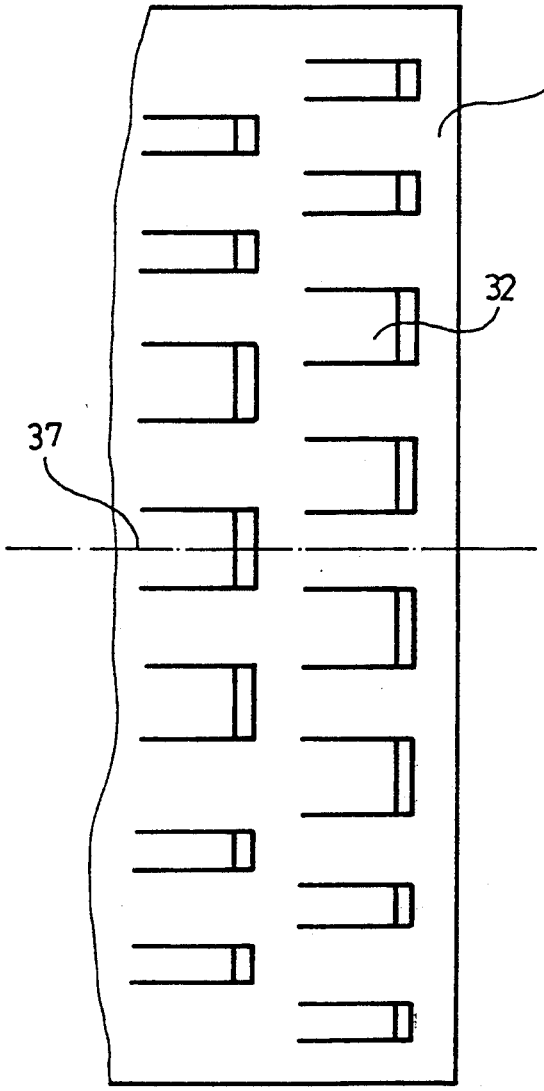
Figure 7:
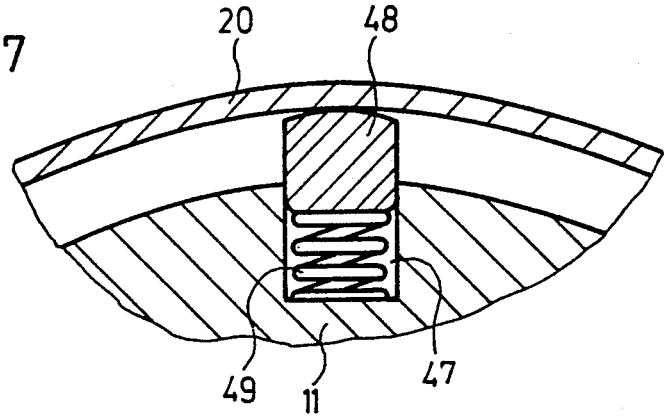
Figure 8A:
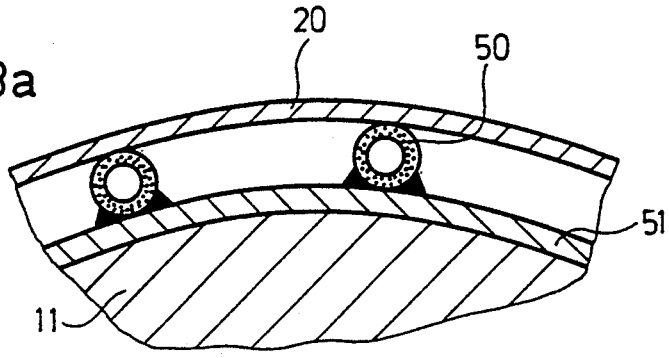
Figure 8B:
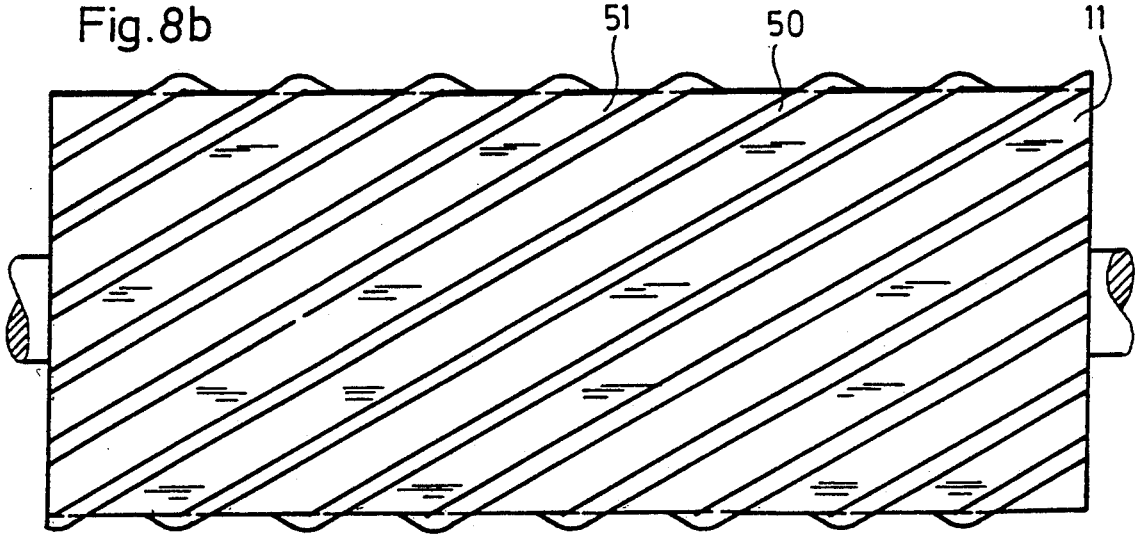
Figure 9A:
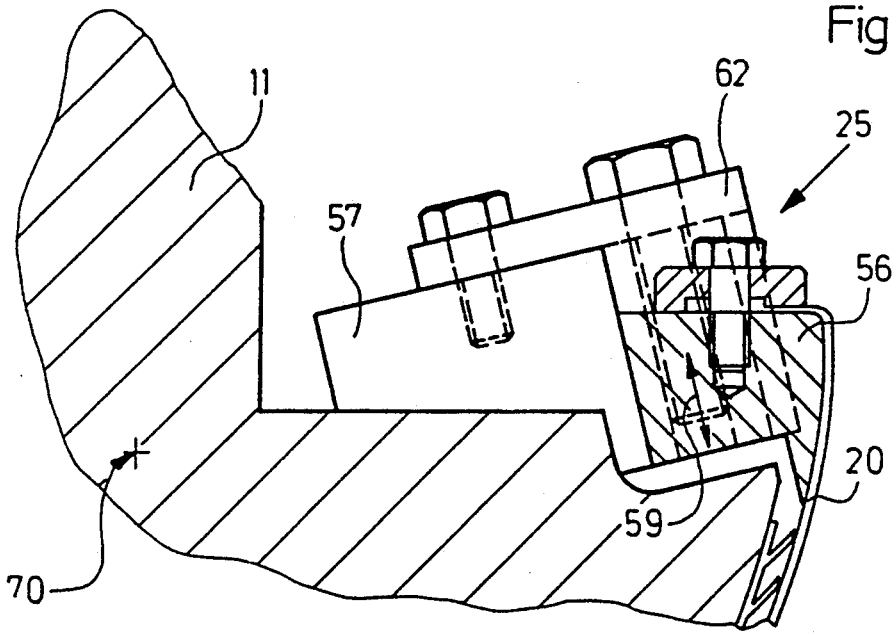
Figure 9B:
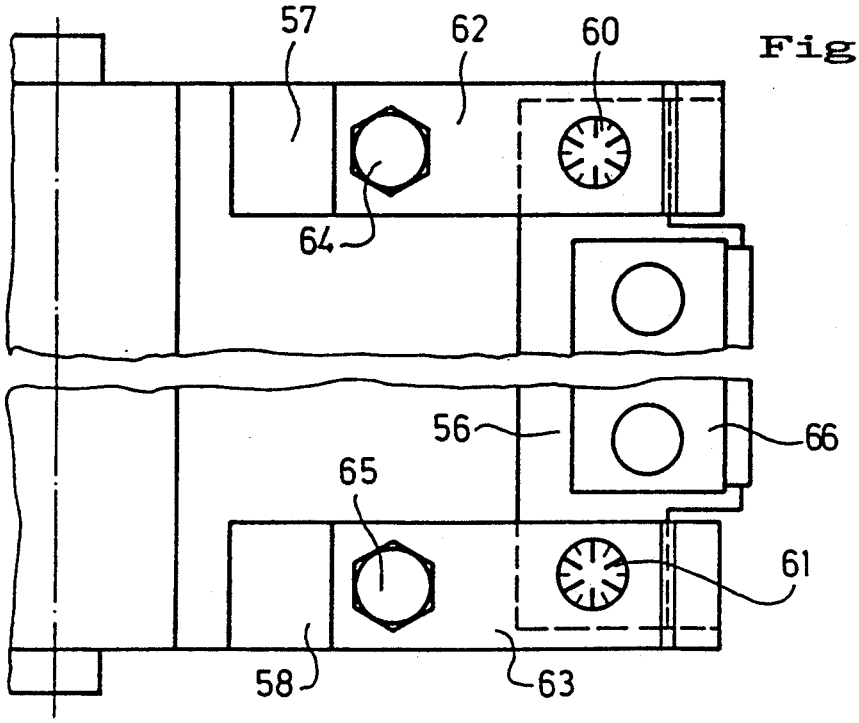
Figure 10:
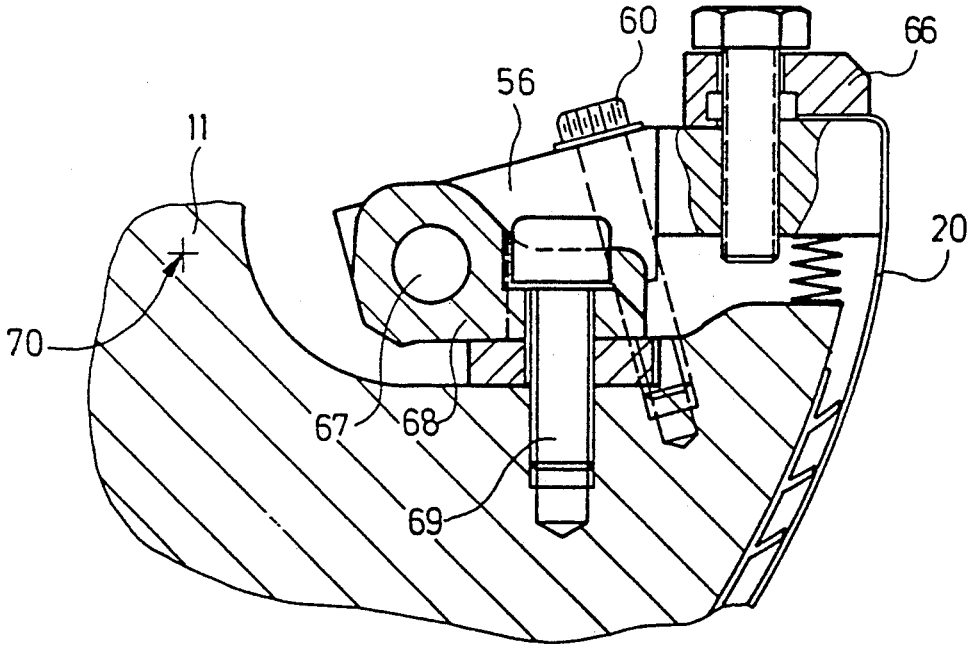

FIGS. 4*a* and 4*b* are fragmentary plan views of the carrier plate shown formed with two different embodiments of the carrier elements;

FIGS. 5*a* and 5*b* are fragmentary plan views of the carrier plate having carrier elements formed in different arrays;

FIGS. 6*a*, 6*b*, 6*c* and 6*d* are fragmentary sectional views of a sheet-guiding drum having additional embodiments of the carrier plate provided with differently constructed carrier elements;

FIG. 7 is a fragmentary cross-sectional view of a sheet-guiding drum having yet a further embodiment of the carrier element;

FIGS. 8*a* and 8*b* are respectively, a fragmentary cross-sectional view and a longitudinal view of a sheet-guiding drum having a carrier plate with hose-shaped carrier elements, the latter view having the jacket or casing foil thereof removed;

FIGS. 9*a* and 9*b* are respective fragmentary sectional and plan views of another embodiment of an adjustment device forming part of the invention; and FIG. 10 is a view similar to that of FIG. 9 showing yet a further embodiment of the adjustment device.

Figure 1:
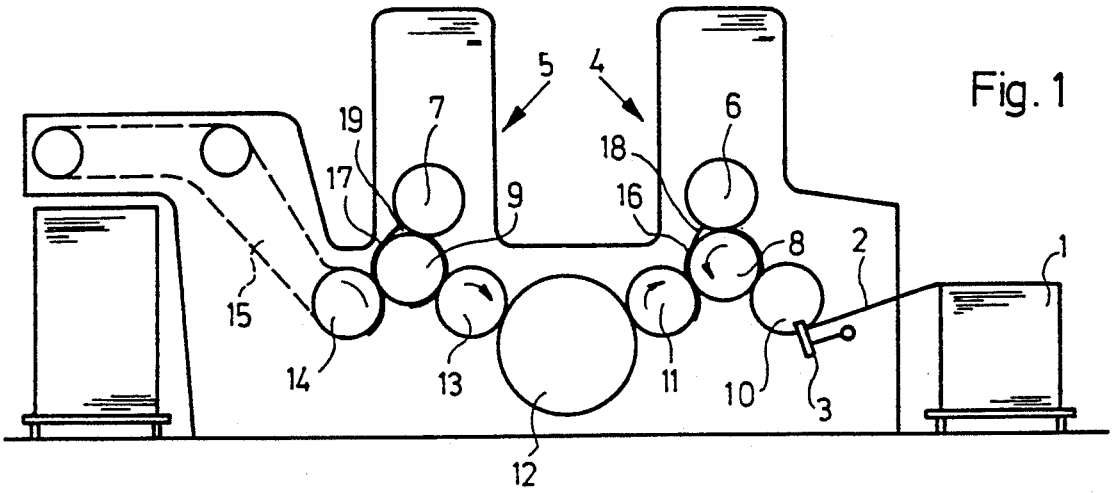
FIG. 1 is a diagrammatic side elevational view of a sheet-fed rotary printing machine.

Referring now to the drawing and more specifically to FIG. 1 thereof, there is shown therein diagrammatically a sheet-fed rotary printing machine having in succession, at the sheet-feeding side thereof, a feeder 1 and a feed table 2 with a front lay 3. Respective printing units 4 and 5 are individually provided with a blanket cylinder 6, 7 and an impression cylinder 8,9. Furthermore, a first feeding drum 10, a first transfer drum 11, a second transfer drum having twice the diameter of either of the drums 10 and 11 i.e. a storage drum 12, a third transfer drum 13 and a delivery drum 14 with a chain delivery 15 are shown in a successive arrangement. Paper sheets 16 and 17 printed in first form are, respectively, disposed on each of the impression cylinders 8 and 9.

Heretofore, it was conventional to measure the diameter of the feeding drum 10 and the transfer drums 11, 12 and 13 so that during the transport of a sheet with maximum thickness no pull or tension would be exerted on the sheet in the transport direction due to varying transport speeds. The transport speed for the same rotary speeds of the individual drums is dependent upon the mean transport diameter. If sheets which are relatively thin are guided by transfer drums having such a diameter then, due to the smaller, mean transport diameter, which the thin paper assumes on the transfer cylinder, a so-called sheet followers or trailer portion 18, 19 i.e. the sheet which is guided by a transfer drum having a diameter which is too small to adhere to the blanket cylinder due to the cohesion of the ink and is torn away from the blanket cylinder abruptly and uncontrollably. This results in a smearing of freshly printed sheet surfaces, primarily in the case of first form and perfector printing. In the case of a very thick application of ink, thin follower portion becomes noticeable disadvantageously by an increased tendency to smearing. This drawback or fault is, in fact, partly eliminated by providing an underlay for the covering of the drums but, on the other hand, however, the provision of such an underlay is troublesome, time-consuming and unreliable.

The covering of the sheet-guiding drums is effected often with an ink-repellant or oleophobic casing or jacket foil, such as a sandblasted chromed nickel foil or a glass-bead blanket. In spite of the use of such ink repellant materials, the follower can nevertheless cause smearing, the effect of which can be kept within acceptable limits only by frequently washing these surfaces.

FIG. 2 shows a support or carrier plate 21 on a sheet-guiding drum, the support plate permitting an adjustment of the diameter of the surface of the drum and, accordingly, preventing the development of any follower or trailer. The transfer drum 11 shown in FIG. 2 is provided with a tensioning device 55. A casing foil 20 with a roughened surface to tension in this tensioning device 55. A support plate 21 is disposed underneath this casing foil 20. Resilient or springy support or carrier strips 22 are provided on the support plate 21 over the entire surface thereof, and are thus disposed on the surface of the transfer drum 11.

The casing foil 20 is suspended at the other tensioning end thereof on a spring strip 23 and is tensioned by the spring action of this spring strip 23. The spring strip 23 is fastened by suitable fastening means such as screws 24, only one of which is shown in FIG. 2, to the transfer drum 11. The spring force of the spring strip 23 is such that the support strips 22 are in a compressed states i.e the outer diameter of the casing foil 20 is at a minimum. To change the outer diameter i.e. to increase it, an adjustment device 25 formed of a knurled-head screw 26 is provided which is fastened by a threaded pin 27 in the transfer drum 11. Rotary movement of the knurled-head screw 26 effects an adjustment of the spring strip 23 and, accordingly, a change in diameter of the casing foil 20. The knurled-head screw 26 may be provided at an end thereof or on the peripheral surface thereof with a scale which indicates the change in diameter in a given unit of measurement.

The possibility further exists of using a servo-system instead of a manual adJustment device wherein an electrical or pneumatic drive is provided with which, by remote control, an adjustment of the tension in the spring strip 23 and, accordingly, a change in the outer diameter of the casing foil can take place Such remote control devices are generally known in the printing machine field, and are used, for example, to remotely control the individual ink blades of inking zones.

For the purpose of effecting an adjustment diameter over the entire width of the transfer drum 11, both a single adjustment device 25, as well as several adjustment devices disposed along the spring strip 23 may be provided. If several adjustment devices 25 are provided, the possibility then exists accordingly of giving the casing foil 20 a concave or convex shape along the drum axis by varyingly adjusting the individual adjustment devices. Due to the development of a convex shape, for example, narrow printing is able to be avoided, because the sheet, during the printing process, on the one hand, still remains in the printing gap and, on the other hand, is wound around the transfer drum by the grippers at the leading edge of the sheet and stretched in the middle with respect to the marginal regions thereof.

In FIG. 3*a*, the principal operating manner of a spring plate with support elements is illustrated. This figure shows a transfer drum 11 and a support plate 28, as well as a casing foil 20, arranged thereon. The support plate 28 has support elements 29 and 30 on which the casing foil 20 is disposed. A tensile force F acting in peripheral direction of the transfer drum 11 applies radially directed forces $F_R$ on the casing foil 20 which are directed opposite to the spring forces of the support elements 29 and 30 and press these spring elements 29 and 30 occurs. A directed force F on the casing foil 20 thus reduces the outer diameter of the casing foil 20. This diameter reduction is indicated by the course of the casing foil 20 and the support elements 29 and 30 shown in the broken lines. The relative motion between the casing foil 20 and the support elements 29 and 30 can be improved by suitable sliding media such as oil or a sliding foil.

FIG. 3*b* shows a support plate 28 having support elements 29 and 30 which are directed towards the transfer drum 11, and the support plate 28 per se supports or carries the casing foil 20. Due to this arrangement, the casing foil 20 supports the large surface of the support plate 28 in an advantageous manner. This arrangement is self-evidently possible for all of the different embodiments illustrated herein.

To avoid the relative movement between the casing foil 20 and the support elements 29 and 30, the possibility exists of forming the length of the support elements and the angle of contact thereof along the periphery of the transfer drum 11 differently and, in fact, in a manner that the support elements 29 and 30 have a great length and a flat contact angle in vicinity of a fixed tensioning location 55 of the casing foil 20. In vicinity of the adjustable tensioning location (adjustment device 25) of the casing foil 20, the support elements 29 and 30 have a short length and a steep contact angle. Through suitable dimensioning of the lengths and the contact angles, the support elements 29 and 30 act as a coupling rod between two parts which are mutually movable, so that no relative motion occurs between the casing foil 20 and the support elements 29 and 30. Such a construction is shown in FIG. 3*c*. A support plate 28 with support elements 29*a* to 29*g* is disposed on a transfer drum 11. The support elements 29*a* to 29*g* support the casing foil 20. As is apparent, the support elements 29*a* to 29*g* are of varying length and have different contact angles. When the casing foil 20 is tensioned by the adjustment device 25, the stressing of the support elements 29*a* to 29*g* into the positions thereof shown in phantom effects a peripheral shift of the support plate 28. This peripheral shift or displacement is equal to the longitudinal movement of the casing foil 20.

In another construction of the support plate 28 as shown in FIG. 3*d*, the casing foil 20 is held by both ends thereof in one adjustment device 25 which is formed of a shaft 52 which can be turned. The turning movement of this shaft 52 effects a tensioning or loosening of the casing foil 20 fastened to the shaft 52. Recesses are formed in the casing foil 20 for grippers 53 and gripper seats arranged on the transfer drum 11. The support elements 29 extend in different directions, as viewed from a middle line 54 of the support plate, so that a uniform and concentric diameter change is effected by the tensioning of the casing foil 20. The support elements 29 shown in FIG. 3*d* can be provided, as illustrated in FIG. 3*c*, with varying lengths and varying contact angles to prevent relative motion between the support plate 28 and the casing foil 20 in engagement therewith.

As shown in FIG. 4*a*, a support element may be formed of a simple resilient or springy tongue 32 which has been punched out of the support plate 28. The support plate 28 is advantageously formed of a springy plate material. The effective spring length of this spring tongue 32 corresponds to the total length thereof.

If the spring tongue 33 has sides 34 and 35 extending edgewise therefrom, as shown is FIG. 4*b*, the effective spring length then extends substantially only over the region of the bend 36 thereof. Through the shape of the spring tongues 32 and 33, a simple manner of influencing the effective spring length is possible.

FIG. 5*a* shows the distribution of support elements 32 on a support plate 28 in a plan view. The support elements are also constructed here as spring tongues 32. The individual rows of spring tongues are mutually offset in order to achieve as uniformly as possible a support of the casing foil which incidentally is not illustrated in FIG. 5*a*.

In FIG. 5*b*, a distribution of spring tongues 32 on a support plate 31 is shown wherein those spring tongues which are located in vicinity of the center line 37 of the transfer drum have a greater width then the outer spring tongues. This causes a slightly spherical convex surface to be formed along the cylinder axis of the transfer drum when a tensioning force is applied uniformly over the entire width of the transfer drum. Naturally, it is also possible to arrange the wider spring tongues at the marginal region of the transfer drum. A concave construction of the casing foil is thereby achieved.

FIGS. 6*a* to 6*d* show different additional embodiments or constructions of the support elements.

Figure 6A:
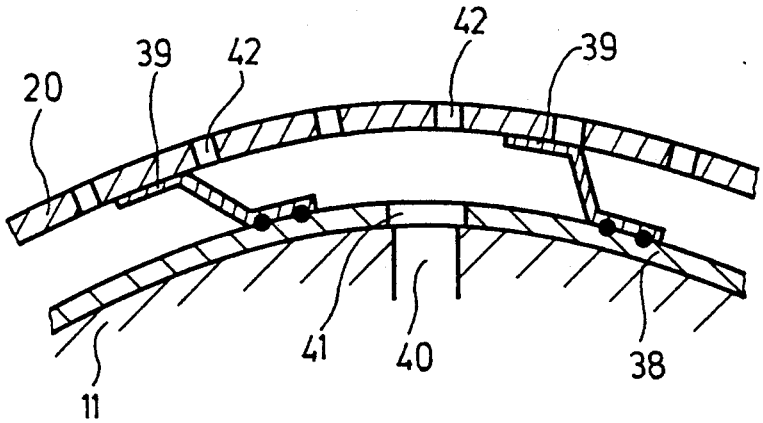

FIG. 6*a* shows a support plate 38 on a transfer drum 11. Spring tongues 39 are fastened to the support plate 38. The type of fastening may be as necessary or desirable, for example, the spring tongues 39 can be fastened to the support plate 38 by point welds. Likewise, these spring tongues 39 can be secured by rivet connections or adhesive connections to the support plate 38.

In many applications of the device according to the invention, it is advantageous to produce an air cushion between the casing foil 20 and the surface of the sheet disposed thereon. For this purpose, as shown in FIG. 6*a*, the transfer drum 11 is provided with an air supply channel 40, the support plate 38 is formed with a bore above the air supply channel 40 and also the casing foil 20 and can form an air cushion. The production of an air cushion is possible, naturally, for all of the embodiments of the support elements illustrated herein.

Figure 6B:
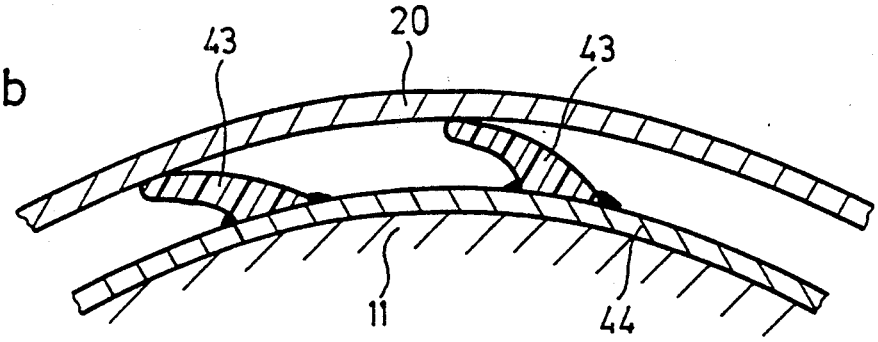

The support elements 43 shown in FIG. 6*b* are formed of rubber or synthetic material, such as polyurethane, for example. This material is secured with adhesive or by vulcanization to a support material 44. Due to the construction of the support elements 43 so that they extend sidewise, a spring action occurs which permits a uniform reduction in diameter and increase in diameter, respectively, over the entire periphery of the sheet-guiding or transfer drum.

Figure 6C:
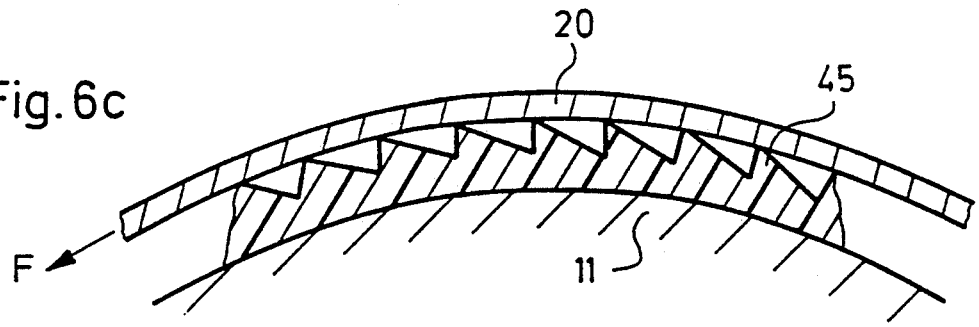

A further different embodiment of the invention is illustrated in FIG. 6*c*. The support element 45 is formed of a support foil which is constructed on one side thereof with a saw-tooth shape and which lies on the transfer drum 11. This foil is formed of rubber or synthetic material, for example. A pulling or tensioning movement exerted upon the casing foil 20 in the direction of the arrow F effects a lateral compression of the saw-tooth-shaped elements and, accordingly, a reduction in diameter as well.

Figure 6D:
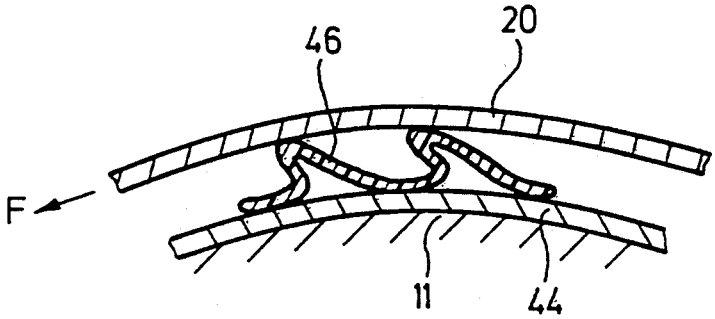

Another embodiment of the support element is shown in FIG. 6*d* and is formed of a thin foil 46 of synthetic material with a loop-shaped structure which is mounted on a support material 44. The type of structure produces a folding or bending movement of the loop and, accordingly, a reduction in diameter, when a pulling movement is applied to the casing foil 20 in the direction of the arrow F.

A somewhat altered or modified embodiment of support elements is shown in FIG. 7. Bores or slits 47 are formed in the surface of the transfer drum 11. Cams or continuous strips 48 are inserted into these bores or slits 47 and are supported by or braced against one or more springs 49. The casing foil 20 is disposed directly on the cams and strips, respectively. When the casing foil 20 is stretched or subjected to tension, the cams and strips, respectively, dip into the transfer drum 11.

An additional embodiment of the support elements is shown in FIG. 8*a*. Elastic hose sections 50 are adhesively secured to a support foil 51. Stretching or tensioning the casing foil 20 causes these hose lengths or sections 50 to deform into an ellipse and, consequently, also permits the outer diameter of the casing foil 20 to be reduced.

In FIG. 8*b* shows an arrangement of such hose lengths or sections 50 on the peripheral surface of a transfer drum 11. Due to the arrangement of these hose lengths 50 at an angle inclined to the longitudinal axis on the support foil 51, a uniform support surface for supporting the casing foil is produced. Instead of hose lengths or sections, the support elements could also be formed of cellular or expanded rubber-type strips. The spring action of such strips and such hose lengths, respectively, varies in accordance with the type of material and is therefore selective in accordance with the particular requirements.

In all of the illustrated embodiments of the invention, a sliding medium or a sliding foil can be disposed between the casing foil 20 and support elements 29 and 30. It is also possible, furthermore, to provide the support elements 29 and 30 themselves with sliding properties by making them of a suitably selected synthetic material. Due to good slidability, a uniform change in diameter is achieved over the entire periphery of the transfer drum.

In FIGS. 9*a* and 9*b*, an adjustment device 25 is shown which effects an exactly defined movement of the casing foil 20 in peripheral direction and simultaneously in radial direction. This adjustment device 25 includes a tensioning rail 56 which is guided on guide rails 57 and 58 fastened laterally to end faces of the sheet-guiding drum 11. The guidance for the tensioning rail 56 is constructed as a longitudinal guide. The tensioning rail 56 is displaceable in the direction of the arrow 59. Movement of the tensioning rail 56 is effected by adjustment screws or setscrews 60 and 61 which are braced against cover plates 62 and 63 which are fastened to the guide rails 57 and 58 by screws 64 and 65. The adjustment screws 60 and 61 are furnished with a respective scale which permits a targeted adJustment of the tensioning rail 56, and thereby of the diameter, to a specific value. The casing foil 20 is clamped to the tensioning rail 56 by a clamping rail 66.

Another embodiment of the adJustment device is shown in FIG. 10 wherein the casing foil 20 is shown also fastened by a clamping rail 66 to a tensioning rail 56. The tensioning rail 56 is mounted so as to be swivellable about a pivot 67 on the sheet guiding drum 11, the pivot pin 67 being fastened in bearing members 68 on end faces of the transfer drum 11. The bearing members 68 are threadedly fastened by screws 69 to the transfer drum 11. The tensioning rail 56 has at least one adjustment screw 60 which is arranged in the middle of the tensioning rail 56 and is braced on the transfer drum 11. Throughout this adjustment screw 60, the tensioning rail 56 is able to pivot about the pivot pin 67 and, accordingly, to vary the diameter of the casing foil 20. Due to this pivoting movement about the pivot pin 67, the casing foil 20 is displaced to the tensioning location in the vicinity of the tensioning rail 56 during an adjustment both in peripheral direction as well as in radial direction with respect to the axial center 70 of the transfer drum 11. Due to both of these movements, the diameter of the casing foil 20 is varied with this adjustment device not only within the spring-braced region but also in the region of this tensioning location. The adjustment screw 60 is provided with a scale graduation for exactly adjusting the outer diameter.

What is claimed is:

1. Sheet-guiding drum assembly for sheet-fed rotary printing machines, the assembly comprising a rotatable drum formed with a casing surface and a casing foil disposed peripherally around said casing surface so as to have an outer diameter, said casing foil having an edge leading in direction of rotation of said drum, and an edge trailing in said direction, respective tensioning locations at least at said leading and trailing edges of said casing foil at which said casing foil is fastened to said drum, adjustment means located at least at one of said tensioning locations for imparting a tensioning movement to said casing foil in peripheral direction of said casing surface, a member arranged beneath the casing foil and on the casing surface of the drum, said member having a multiplicity of individual support elements for yieldingly supporting said casing foil over the entire surface thereof on said casing surface of said drum, and means for substantially uniformly varying the height of said member on the casing surface and thereby substantially uniformly varying said outer diameter of said casing foil over substantially the entire periphery thereof.

2. Assembly according to claim 1, wherein said adjustment means comprise device having means for simultaneously moving the casing foil both in peripheral direction of the drum as well as in radial direction thereof, the movement of the casing foil in radial direction corresponding to a reduction in the outer diameter of the casing foil resulting from the movement of the casing foil in the peripheral direction.

3. Assembly according to claim 1, wherein said adjustment means comprise a tensioning rail extending along the axis of the drum and mounted in guide rails at end faces of the drum, the casing foil being fastened to said tensioning rail, said tensioning rail being moveable in a direction which is inclined to a tangent to said tensioning location of the casing foil on the sheet-guiding drum.

4. Assembly according to claim 1, wherein said adjustment means comprise a tensioning rail for tensioning the casing foil, said tensioning rail being arranged within the drum so as to be swivellable about an axis extending substantially parallel to the axis of the drum.

5. Assembly according to claim 1, including means for yieldingly fastening the casing foil to at least one tensioning location of the sheet-guiding drum, said means for varying the height of said member comprising a servo-device.

6. Assembly according to claim 1, wherein said member is formed of a support plate and said support elements are spring tongues distributed over the surface thereof.

7. Assembly according to claim 1, wherein said member is formed of a support material having resiliently acting support elements.

8. Assembly according to claim 1, wherein said member is formed of a support material wherein resiliently acting support elements of rubber or synthetic material are disposed.

9. Assembly according to claim 1, wherein said member is formed of at least one length of elastic hose fastened to a support foil.

10. Assembly according to claim 1, wherein said member is formed of a plurality of strips arranged together with spring elements in a surface structure of the drum so that said strips are spring-biased in radial direction of the drum.

11. Assembly according to claim 1, wherein said member is formed of a plurality of cams, and said supporting elements are spring elements arranged together with said cams in a surface structure of the drum so that said cams are spring-biased in radial direction of the drum.

12. Assembly according to claim 1, wherein said yieldingly supporting support elements are resiliently biased in a direction out of a normal to the peripheral direction of the drum.

13. Assembly according to claim 1, wherein said member and the casing foil are formed with openings for conducting blowing air therethrough to the surface of a printed sheet disposed on the casing foil.

14. Assembly according to claim 1, wherein said adjustment means comprise at least three like mechanisms distributed over the length of the drum.

15. Assembly according to claim 1, wherein said adjustment means is assembled with at least one servo-drive connected to a remote-control unit.

16. Assembly according to claim 1, including means for promoting a sliding effect disposed between said support elements and at least one of the casing foil and the casing surface of the sheet-guiding drum for reducing friction.

17. Assembly according to claim 16, wherein said means for promoting a sliding effect are selected from the group consisting of sliding media and sliding foils.

18. Assembly according to claim 1, wherein said adjustment device is formed as a shaft to which the casing foil is connected, said shaft being turnable for respectively tensioning and loosening the casing foil.

19. Assembly according to claim 18, wherein grippers and gripper seats are mounted on said drum, and the casing foil is formed with recesses through which said grippers and gripper seats extend.

* * * * *